United States Patent [19]

Jeffries et al.

[11] Patent Number: 4,858,576

[45] Date of Patent: Aug. 22, 1989

[54] GLOW PLUG ALTERNATOR CONTROL

[75] Inventors: James R. Jeffries, East Peoria; Michael R. Verheyen, Peoria, both of Ill.

[73] Assignee: Caterpillar Inc., Peoria, Ill.

[21] Appl. No.: 231,422

[22] PCT Filed: Nov. 4, 1987

[86] PCT No.: PCT/US87/02878

§ 371 Date: Nov. 27, 1987

§ 102(e) Date: Nov. 27, 1987

[87] PCT Pub. No.: WO88/03991

PCT Pub. Date: Jun. 2, 1988

Related U.S. Application Data

[63] Continuation-in-part of Ser. No. 935,897, Nov. 28, 1986, Pat. No. 4,726,333.

[51] Int. Cl.[4] ..... F02P 19/02

[52] U.S. Cl. ..... 123/145 A; 219/497

[58] Field of Search ..... 123/145 A, 179 B, 179 BG, 123/179 H; 219/497, 504, 505

[56] References Cited

U.S. PATENT DOCUMENTS 4,322,604 3/1982 Kawamura et al. ..... 123/145 A
4,377,138 3/1983 Mitani et al. ..... 123/145 A
4,552,102 11/1985 Egle ..... 123/145 A
4,594,975 6/1986 Shigenobu ..... 123/145 A
4,726,333 2/1988 Verheyen ..... 123/145 A

*Primary Examiner*—Andrew M. Dolinar
*Attorney, Agent, or Firm*—Robert E. Muir

[57] ABSTRACT

The present invention pertains to a control system for igniting devices (28,30,32,34,36,38) used in an internal combustion engine (24). In order to ignite alcohol fuel in a diesel engine, the fuel must be heated before or during compression. Glow plugs (28,30,32,34,36,38) conveniently provide heat, but have a short life in such continuous applications. Glow plugs must be accurately controlled to prevent overheating, which leads to open-circuiting. Individual constant voltage controls attempt to provide this function, but are only moderately successful. They are costly and complex, and provide only moderate protection from overheating. Since glow plug resistance correlates to glow plug temperature, resistance control provides better protection against glow plug overheating. Therefore, an apparatus (20) monitors the resistance of a single glow plug (28), and controls the resistance of each glow plug to a preselected resistance value. This preselected resistance value represents a glow plug temperature, that provides satisfactory fuel combustion combined with improved glow plug life. The principal use of the apparatus (20) of the present invention is with internal combustion engines using alternate fuels.

8 Claims, 5 Drawing Sheets

THRESHOLD RESISTANCE
78
COMPARATOR
81
PRESELECTED RESISTANCE
50
COMPARATOR
48
PRESELECTED VOLTAGE
68
66
COMPARATOR
84
82
86
DIVIDER
46
52
OUTPUT MEANS
I→V CONVERTOR
60
CURRENT SENSOR
40
VOLTAGE SENSOR
44
+26
-
CONTROLLING SIGNAL
IGP
VGP

GLOW PLUG ALTERNATOR CONTROL

This application is a continuation-in-part of application Ser. No. 935,897, filed Nov. 29, 1986, now U.S. Pat. No. 4,726,333.

DESCRIPTION

1. Technical Field

This invention relates generally to an apparatus for controlling igniting devices of an internal combustion engine and more particularly to an apparatus for continually regulating the resistance of glow plugs over the temperature range of an operating engine.

2. Background Art

In today's world of dwindling and unsteady petroleum supplies, many human resources are devoted to the selection and refinement of alternate fuels. Furthermore, many "third world" countries that cannot afford high priced foreign petroleum are forced to use various types of domestic fuel. However, the use of most alternate fuels causes the malfunction of traditional engines and the deterioration of their components.

Recently, new polymers have substantially cured the latter problem, leaving the functional problem as the greatest challenge to overcome. This problem manifests itself in inefficient combustion. Ignition of some of these fuels requires a catalyst. Diesel engines, for instance, must provide heat, in addition to compression, to ignite the alternate fuel.

Glow plugs assist combustion in alcohol fueled engines. Unfortunately, energizing a glow plug in the continuously changing temperature of an operating engine poses additional problems. Glow plugs are utilized primarily for starting engines and can be damaged quite easily if used over longer periods of time.

Precision voltage controls attempt to prolong glow plug life. These controls maintain a constant glow plug voltage. As the engine heats, the glow plug remains driven by the constant voltage. Soon cylinder temperature exceeds the temperature required for combustion. Therefore, the glow plugs waste energy and glow plug life shortens.

Additionally, in many systems, each glow plug requires a separate control to step down the vehicle electrical system voltage to levels which provide satisfactory fuel combustion and adequate glow plug life. A control scheme of this type wastes money and is unnecessarily complex. For example, a six cylinder engine requires six controls.

The present invention is directed to overcoming one or more of the problems as set forth above.

DISCLOSURE OF THE INVENTION

In accordance with one aspect of the present invention an apparatus controls the resistance of a glow plug over various operating temperature ranges of an internal combustion engine. The apparatus is electrically powered by a first alternator. A means produces a resistance error signal in response to the glow plug's resistance differing from a preselected glow plug resistance. A second alternator means delivers a voltage signal to the glow plug to control glow plug's resistance relative to the preselected resistance in response to receiving the resistance error signal.

In accordance with still another aspect of the present invention an apparatus controls the resistance of a glow plug over various operating temperatures of an engine.

The current through the glow plug is sensed and a signal relative to the sensed current is delivered. The voltage across the glow plug is sensed and a signal relative to the magnitude of the sensed voltage is delivered. The sensed current and voltage signals are modified to include a preselected resistance. The modified current signal is compared to the modified voltage signal to produce a resistance error signal in response to a difference between the compared signals. A voltage signal is delivered to the glow plug to control the glow plug resistance relative to the preselected resistance to response to receiving the resistance error signal.

Alternate fuels, such as alcohol, are becoming commonplace in many areas of the world. In order to burn alcohol fuel in a diesel engine, additional heat must be supplied, usually from the glow plugs already present in the engine. Since glow plugs are not designed for prolonged use, they typically fail within a short period of time. Precision voltage controls attempt to regulate the glow plugs during operation to lengthen their usable lives. As the engine operates and its temperature changes, the voltage controls tend to overdrive the glow plugs and the glow plugs overheat. Therefore, while these controls do prolong glow plug life, additional operating life can still be coaxed from a glow plug.

As a solution to this problem, the present invention regulates the glow plug power output in response to temperature changes in the cylinders of the engine. It has been observed that glow plug temperature varies with glow plug resistance. Therefore, glow plug resistance is monitored as an indication of temperature. By controlling the resistance of the glow plugs, their functioning temperature is controlled. Longer life results in response the glow plugs being protected from overheating.

Another advantage of the present invention is the reduction of complexity and cost. The present invention monitors one glow plug and controls all of them. The apparatus monitors only one glow plug, since there is little variation between glow plug parameters in an operating engine. This scheme eliminates the waste of duplicate controls for each glow plug.

BEST MODE FOR CARRYING OUT THE INVENTION

Figure 1:
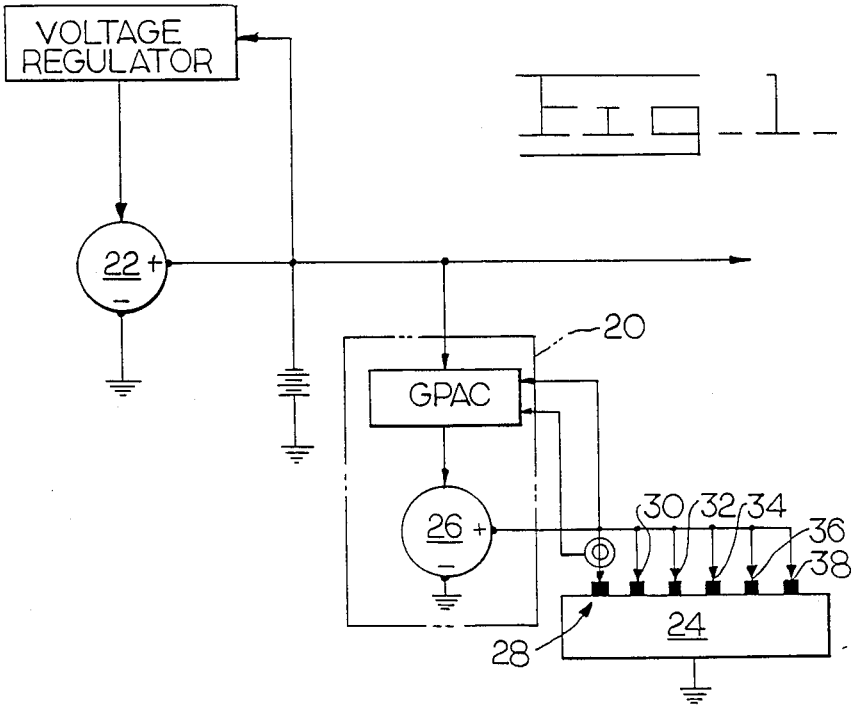
FIG. 1 illustrates the connection of the present invention to a typical vehicle electrical system.

FIG. 1 illustrates the system connection scheme of the glow plug alternator control apparatus 20. Power is provided to the apparatus 20 from a first alternator, the system alternator 22. The apparatus 20 senses the voltage and current through the glow plug 28 of the engine 24. The apparatus 20 determines the resistance of the glow plug 28 and compares it to a preselected resistance. A resistance error signal is delivered in response to a difference between the compared signals. A second alternator 26 is responsive to the resistance error signal and delivers a voltage signal to the glow plug 28 to control its resistance to the preselected resistance value. In addition, since the glow plugs 30,32,34,36,38 are connected in parallel with the glow plug 28, all of the glow plugs 30,32,34,36,38 are controlled to the preselected resistance.

Figure 2:
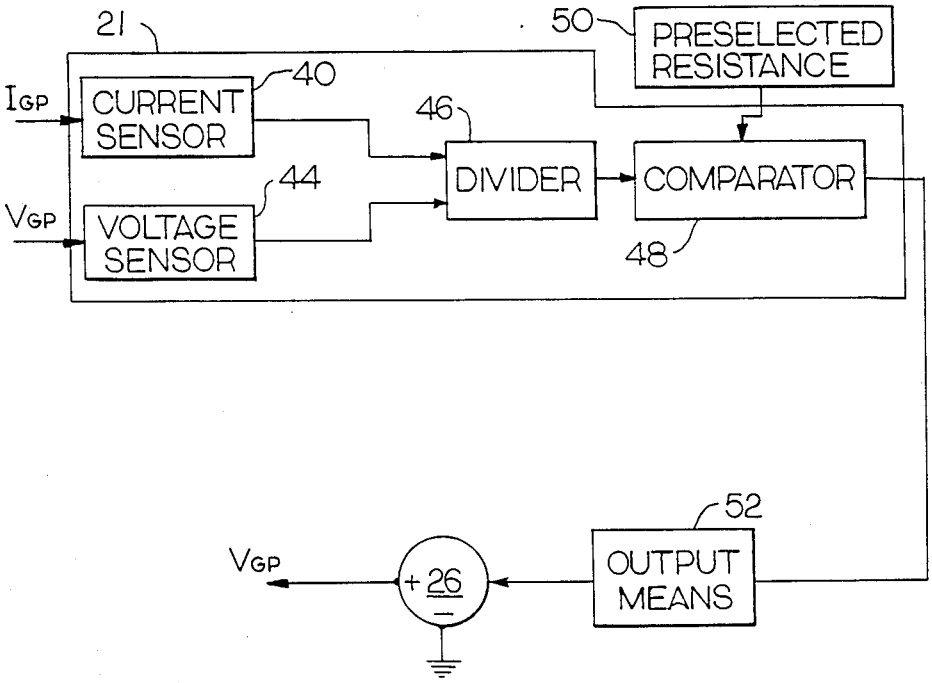
FIG. 2 illustrates a functional block diagram of one embodiment.

Refer now to FIG. 2 which illustrates a diagrammatic break down of the functions performed by the apparatus 20. A means 21 determines the resistance of a glow plug 28 in the following manner. A current sensor 40 senses the glow plug 28 current and delivers a signal relative to the magnitude of the sensed current. A voltage sensor 44 senses the glow plug 28 voltage and delivers a signal relative to the magnitude of the sensed voltage. These two signals are input to a divider means 46, where the sensed voltage signal is divided by the sense current signal and a glow plug resistance is obtained.

The means 21 also delivers a resistance error signal in the following manner. A comparator 48 receives the obtained resistance signal and compares it to a preselected resistance signal delivered by a signal delivering means 50. The comparator 48 delivers a resistance error signal in response to a difference between the obtained resistance signal and the preselected resistance signal. An output means 52 receives the resistance error signal and delivers an alternator input signal in response thereto. The second alternator means 26 is responsive to the input signal. The second alternator means 26 delivers a resistance controlling signal to the plurality of glow plugs. The signal controls the resistance of each glow plug relative to the preselected glow plug resistance.

The voltage and current of one of a plurality of glow plugs is monitored. The voltage is divided by the current to obtain an indication of the glow plug's resistance. This value is compared with a preselected glow plug resistance, that is the desirable resistance of the glow plug. If the obtained resistance differs from the preselected resistance, the glow plug resistance is increased or decreased until it substantially equals the preselected resistance. As mentioned earlier in this specification, glow plug resistance is related to glow plug temperature. An operating engine cycles through a range of temperatures, so the temperature of the glow plugs changes. The apparatus 20 continuously monitors the resistance of a glow plug and controls the resistance of the plurality of glow plugs to protect them from overheating. Due to this substantially continuous resistance feedback, the glow plug resistance is prevented from drifting undesirably from the preselected resistance. The resistance control range is plus or minus five percent of said preselected glow plug resistance signal value.

Figure 3:
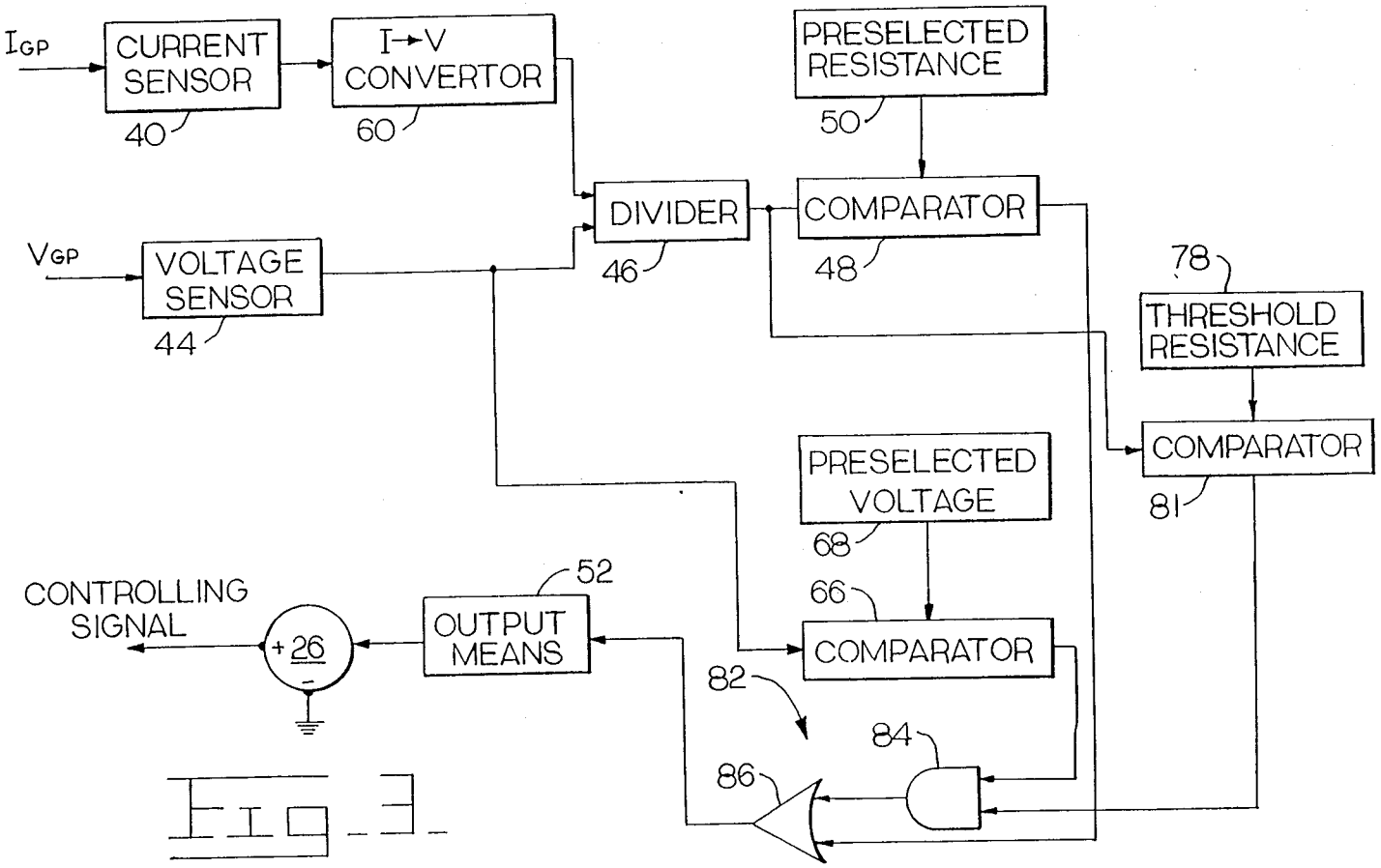
FIG. 3 illustrates a functional block diagram of one embodiment coupled with a constant voltage control for glow plugs.
Figure 4:
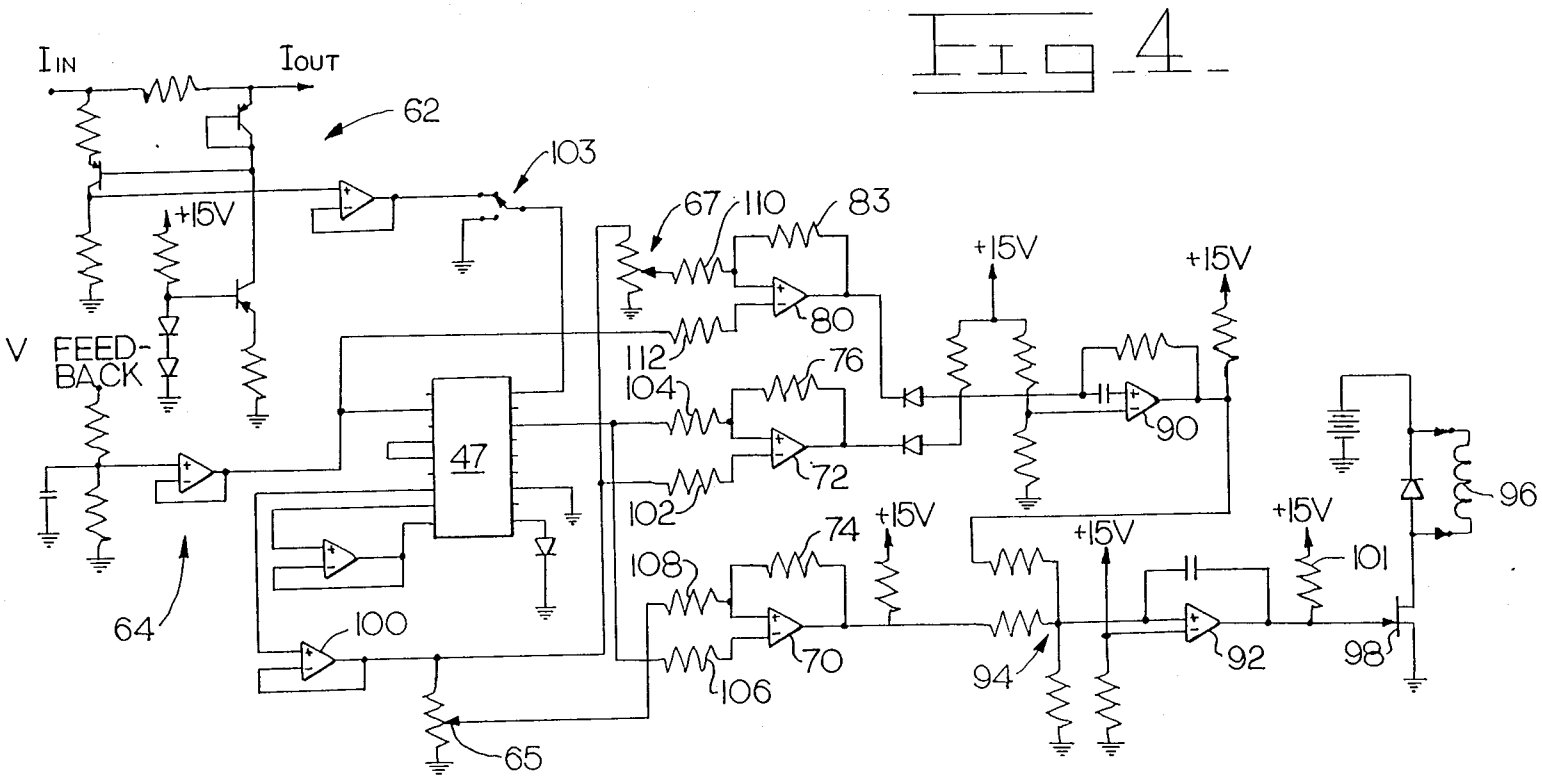
FIG. 4 illustrates a schematic of the embodiment of FIG. 3.

Referring to FIGS. 3 and 4 which show another embodiment of the apparatus 20. FIG. 3 illustrates a block diagram of the constant resistance control of FIG. 2, coupled with a constant voltage control. This type of control is desirable in the event of a glow plug failure. Should the monitored glow plug open-circuit, the control switches to a constant voltage type control until the failed glow plug is replaced. FIG. 4 depicts a detailed embodiment of the apparatus 20 of this invention.

A current sensor 40 senses the glow plug 28 current. A means 60 converts the sensed current to a voltage and delivers a signal relative to the magnitude of the sensed current. A current mirror circuit 62, as is well-known in the art, accomplishes these tasks. A voltage sensor 44 senses the glow plug 28 voltage and delivers a signal relative to the magnitude of the sensed voltage. The voltage sensor 44 is shown to be a simple buffered voltage divider circuit 64. The two signals are input to a divider means 46, such as the "AD538" 47 manufactured by Analog Devices of Norwood, Mass. Here the sensed voltage signal is divided by the sensed current signal to obtain a glow plug resistance.

A comparator 48 compares the obtained resistance signal to a preselected resistance signal delivered by a signal delivering means 50, such as a potentiometer 65. The comparator 48 delivers a resistance error signal in response to the obtained glow plug resistance signal being less than the preselected glow plug resistance signal. A comparator 66 compares the sensed glow plug voltage signal to a preselected voltage signal delivered by a signal delivering means 68, also shown to be a potentiometer 67. The comparator 66 delivers a voltage error signal in response to a difference between the sensed and the preselected glow plug voltages. The comparator 66 delivers a voltage error signal in response to the sensed glow plug voltage being less than the preselected glow plug voltage. The resistance comparator 48 and the voltage comparator 66, shown in FIG. 3, are operational amplifiers 70, 80 with stability provided by respective feedback resistors 74, 83, as shown in FIG. 4. The operational amplifier 70 receives the preselected resistance signal from the potentiometer 65 via a resistor 108 and the obtained glow plug resistance from the divider 47 via a resistor 106. The operational amplifier 80 receives the preselected voltage signal from the potentiometer 67 via a resistor 110 and the sensed glow plug voltage signal from the buffered voltage divider circuit 64 via a resistor 112.

A detection circuit determines if a glow plug is open-circuited. A signal delivering means 78, such as an operational amplifier 100, delivers a preselected threshold resistance signal which is relative to the magnitude of a resistance value in the range of less than that of an open-circuited glow plug and greater than the preselected glow plug resistance. As shown in FIG. 4, an operational amplifier 72 is used as a comparator 81, which is shown in FIG. 3. This operational amplifier 72 receives the threshold resistance signal from the operational amplifier 100 via a resistor 102 and the glow plug resistance signal from the divider 47 via a resistor 104. The operational amplifier 72 delivers a 'high' voltage signal in response to the obtained glow plug resistance signal being greater than the preselected threshold resistance signal.

A logic means 82 selects one of the resistance error signal and the voltage error signal in response to the obtained glow plug resistance being respectively less than and greater than the preselected threshold resistance signal, and delivers the selected signal. As shown logically in FIG. 3, an 'AND' gate 84 receives the outputs of the glow plug voltage comparator 66 and the threshold resistance comparator 81. When the glow plug is open-circuited, the 'AND' gate 84 is enabled to deliver the voltage error signal. Furthermore, if the glow plug is open-circuited, the output of the resistance comparator 48 is 'low' since the obtained resistance is greater than the preselected resistance. The outputs of the 'AND' gate 84 and of the resistance comparator 48 are input to an 'OR' gate 86. The 'OR' gate 86 delivers a 'high' signal if any of its inputs are 'high'. Therefore, when the glow plug 28 is operational, the 'AND' gate 84 cannot deliver a 'high' signal, and the resistance error signal is selected. When the glow plug 28 open-circuits, the resistance comparator 48 cannot deliver a 'high' signal, and the voltage error signal is selected. The logic means 82 also includes a switch 103 for selecting said voltage error signal in response to closure of said switch.

In FIG. 4, the logic means 82 includes amplifiers 90,92 adapted for selecting one of the resistance error signal and the voltage error signal in response to the obtained glow plug resistance being respectively less than and greater than the preselected threshold resistance, and delivering the selected signal. The operational amplifier 90 receives output signals from the operational amplifiers 72, 80 and outputs a 'high' signal only if both signals are 'high'. The output signals from the amplifier 90 and the amplifier 70 are input, using a wired 'OR' connection 94 as is well known in the art, to the amplifier 92. The amplifier 92 outputs a 'high' voltage signal if either of the input signals is 'high'. The function of this logic, as described in the previous paragraph, is to select the resistance error signal, when the glow plug 28 is not open-circuited, and to select the voltage error signal, when the glow plug 28 is open-circuited.

An output means 52 receives the selected signal. This signal is converted to a higher powered signal and sent to the input of the alternator means 26. The second alternator 26 receives the input signal. The input signal is pulse width modulated. This is because a 'high' voltage signal results from a resistance or voltage which is less than the respective preselected value, and a 'low' voltage signal results from a resistance or voltage signal which is equal to or greater than the respective preselected value. Upon reception of a 'high' input signal, the current in the alternator field winding 96 increases. This leads to an increase of the alternator's output voltage. If the resistance error signal is selected, the output voltage controls the resistance of the plurality of glow plugs 28,30,32,34,36,38 to the preselected resistance. If the voltage error signal is selected, the output voltage controls the voltage of the plurality of glow plugs 28,30,32,34,36,38 to the preselected voltage.

The output means 52 is shown in FIG. 4 as a field effect transistor 98 with a pull-up resistor 101 connecting the gate of the transistor 98 to a positive voltage source. The gate of transistor 98 receives the selected signal from the output of the operational amplifier 92. When the gate voltage is positive, the transistor turns 'on' and conducts current from the positive voltage source through the alternator winding 96 to circuit ground. When the gate voltage is zero, the transistor turns 'off' and does not conduct current. Controlling the current in the alternator field winding 96 controls the second alternator's 26 output voltage, which is delivered to the glow plugs 28,30,32,34,36,38. In this way, power is supplied to the alternator field winding for transfer to the plurality of glow plugs 28,30,32,34,36,38 for controlling their resistance and temperature.

Figure 5:
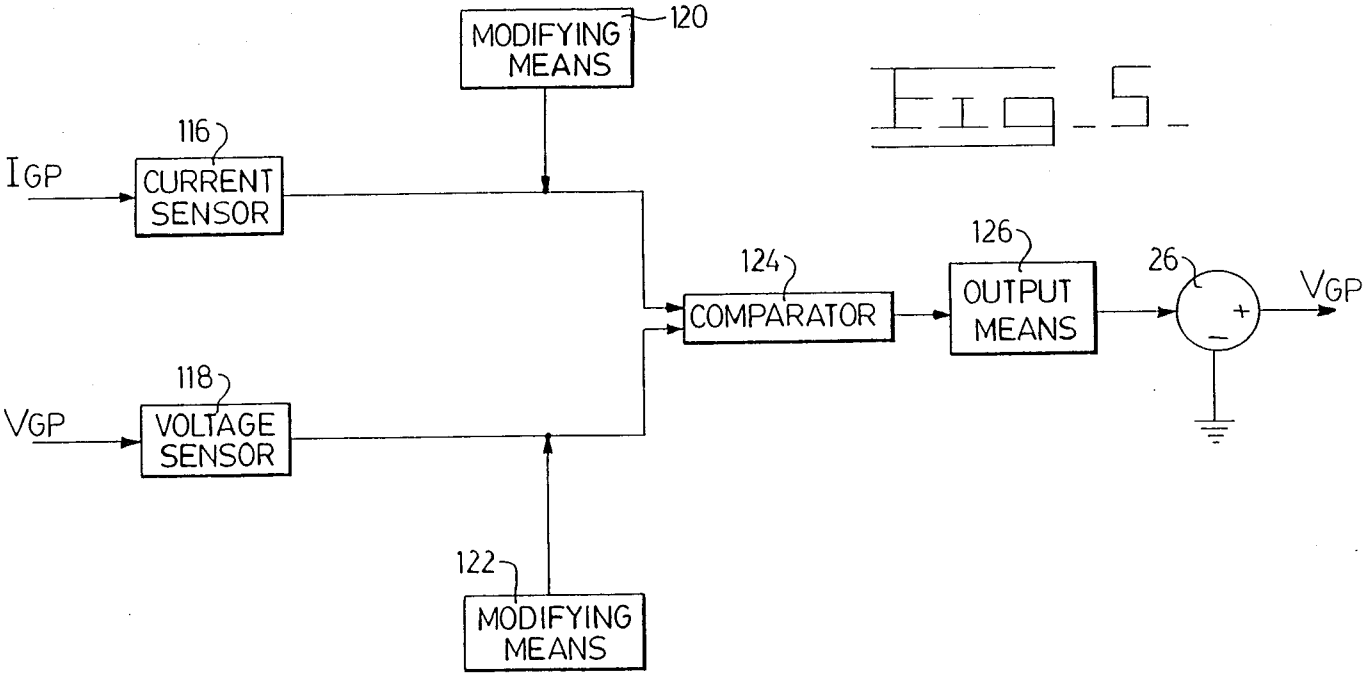
FIG. 5 is a functional block diagram of an alternate embodiment of the present invention.
Figure 6:
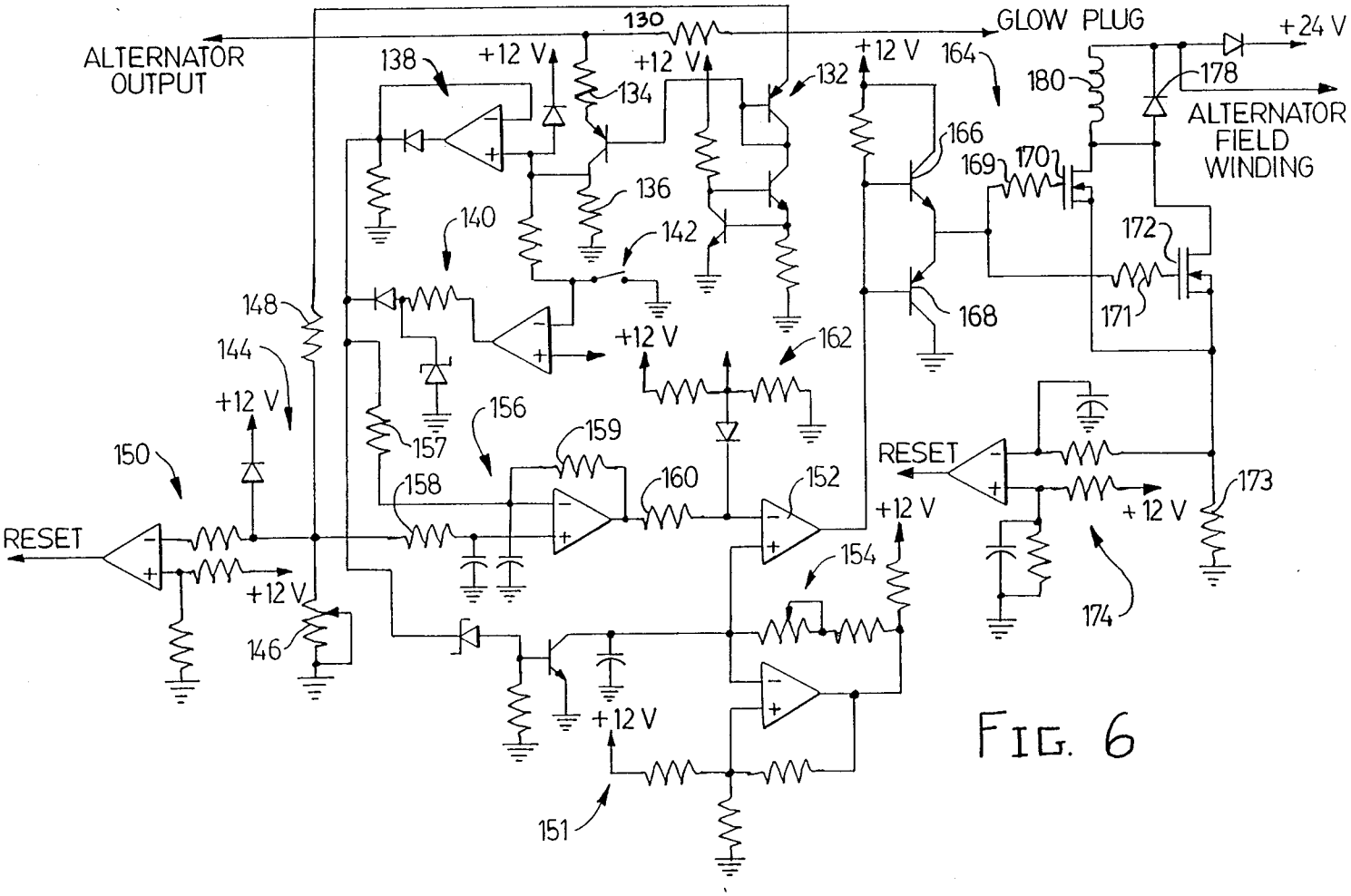
FIG. 6 is a schematic diagram of the embodiment of FIG. 5.

FIGS. 5 and 6 show an alternate preferred embodiment of the apparatus 20. FIG. 5 is a functional block diagram of the alternate embodiment. A current sensor 116 senses current through a glow plug 28 and delivers a signal relative to the magnitude of the sensed current. A means 120 modifies the sensed current signal. The current modifying means 120 effectively multiplies the sensed current signal by a first coefficient to produce a modified current signal, which is correlative to the current through the glow plug 28. This relationship is shown algebraically in eqn. 1.

$$Vi = Igp\ G \qquad \text{eqn. 1}$$

where

Igp is the sensed current through the glow plug;

G is the first coefficient;

Vi is the modified current signal.

Simultaneously, a voltage sensor 118 senses the voltage across the glow plug 28 and delivers a signal relative to the magnitude of the sensed voltage. A means 122 modifies the sensed voltage signal. The voltage modifying means 122 effectively multiplies the sensed voltage signal by a second coefficient and produces a modified voltage signal, which is correlative to the voltage across the glow plug 28. This relationship is shown algebraically in eqn. 2.

$$Vv = Vgp\ H \qquad \text{eq. 2}$$

where

Vgp is the sensed voltage across the glow plug;

H is the second coefficient;

Vv is the modified voltage signal.

Obviously, as the sensed voltage and current sign change value, the modified voltage and current signals change value. If the modified current signal is forced to equal the modified voltage signal, it follows, by algebraic manipulation, that the quotient of glow plug voltage divided by glow plug current is equal to the quotient of the first coefficient divided by the second coefficient. It further follows that the quotient of glow plug voltage divided by glow plug current is equal to the resistance of the glow plug. Since the quotient of the first and second coefficients does not change, the quotient of the first coefficient divided by the second coefficient equals a preselected glow plug resistance. The preceding explanation is expressed algebraically as follows in eqns. 3.

$$Vv = Vi \qquad \text{eqns. 3}$$

$$H\ Vgp = G\ Igp$$

$$G/H = Vgp/Igp = Rgp$$

As the sensed voltage and sensed current change, so does the sensed resistance of the glow plug 28. However, the preselected resistance, the quotient, remains fixed.

A comparator 124 receives the modified signals. The comparator 124 compares the modified voltage signal with the modified current signal and delivers a resistance error signal in response to a difference between the compared signals. Theoretically, if the modified signals are equal, then the sensed resistance of the glow plug 28 equals the preselected resistance (G/H). A difference produces a resistance error signal which, when fed to the glow plug, drives the glow plug's resistance to the preselected value in an attempt to keep the modified signals in equilibrium. The resistance error signal is preferably pulse Width modulated and varies in duty cycle in response to the magnitude of a difference between $V_i$ and $V_v$. For instance, if $V_i > V_v$, the duty cycle increases, whereas if $V_i < V_v$, the duty cycle decreases.

An output means 126 receives the resistance error signal and delivers an alternator input signal in response thereto. The output means 126 preferably amplifies the resistance error signal before it is passed to the glow plug. The second alternator 26 receives the amplified signal and delivers power to the glow plug in response thereto. The effective voltage received by the second alternator 26 effects the power dissipated in the glow plug which consequently alters the temperature of the glow plug. As the temperature of the glow plug changes the glow plug's resistance changes accordingly as previously discussed.

FIG. 6 depicts a detailed embodiment of the apparatus 20. A current sensing resistor 130 senses the current flowing through the glow plug 28. A current mirror 132, of the type well-known in the art, modifies the sensed current by converting it to a voltage and delivering a modified current signal correlative to the magnitude of the sensed current signal. The values of the resistors 130,134,136 in the current mirror 132 are chosen such that the sensed current signal is modified by a first coefficient. The modified current signal is received by an buffering means 138 which has a high impedance input and a low impedance output, and is shown here to be a voltage follower 139. The voltage sensor 118 is shown here to be a simple voltage divider 144 including a potentiometer 146 and a resistor 148. The voltage divider 144 also modifies the sensed voltage by a second coefficient, and delivers a modified voltage signal correlative to the sensed voltage. The values of the potentiometer 146 and the resistor 148 in the voltage divider 144 define the second coefficient. The potentiometer 146 can change resistance to alter the output of the voltage divider 144. The coefficients are chosen such that the quotient of first coefficient divided by second coefficient is equal to the preselected resistance of the glow plug. Moreover, the coefficients are selected such that when the modified current signal equals the modified voltage signal, the glow plug is at the preselected resistance.

An operational amplifier 156 receives the modified current signal from the buffering means 138 via a resistor 157 and the modified voltage signal from the voltage divider 144 via a resistor 158. The operational amplifier 156 delivers a resistance error signal relative to a difference between the modified current signal and the modified voltage signal. The operational amplifier 156 scales the resistance error signal so that it will always fall between an upper and lower preselected voltage. A feedback resistor provides a gain and stability to the operational amplifier 156. The resistance error signal conforms to the following eqn. 4.

$$RES = Vv - Gop(Vi - Vv) \qquad \text{eqn. 4}$$

where

RES is the resistance error signal;

Vv is the modified voltage signal;

Vi is the modified current signal; and

Gop is the gain of the operational amplifier.

If the difference is zero, the resistance error signal causes the same voltage to be applied to the glow plugs as is currently being applied. If the modified current signal is greater than the modified voltage signal, RES is greater than Vv, and vice versa.

A means 151 modulates the resistance error signal. A triangle waveform generator 154 delivers a triangle waveform ranging from the lower to the upper preselected voltages. For example, a lower preselected voltage of +4V and an upper preselected voltage of +6V. The triangle waveform generator 154 can also be momentarily reset to a third preselected voltage, preferably 0V, upon the receipt of a signal from any of several circuit protection devices found throughout the circuit.

The voltage comparator 152 receives the triangle waveform from the triangle waveform generator 154 and the resistance error signal from the operational amplifier 156 via a resistor 160. A pull up means 162 is connected to the line carrying the resistance error signal which prevents the line voltage from falling below a predetermined level. The voltage comparator 152 produces a pulse width modulated (PWM) resistance error signal that has a duty cycle that varies in relation to the magnitude of the resistance error signal.

An output means 164 receives the PWM resistance error signal from the voltage comparator 152. Shown here, in the preferred embodiment, the output means 164 includes two transistors 166,168 connected in a class B "push-pull" arrangement. The "push-pull" arrangement is known in the art to be an active output stage and will not be described in detail herein. The bases of the transistors 166,168 receive the PWM resistance error signal and the emitters deliver an amplified signal via resistors 169,171 to the gates of a pair of field effect transistors 170,172, which are connected in parallel. The sources of the field effect transistors 170,172 are connected to ground via a resistor 173 and also to a means 174 for protecting the field effect transistors 170,172 from an overcurrent condition. If the field effect transistors' output exceeds a predetermined level, the overdrive protection means 174 sends a signal to the voltage comparator 152 which causes the output from the triangle waveform generator 154 to momentarily reset to a preselected voltage. The drains of the field effect transistors 170,172 are connected to the field winding 96 of the second alternator 26 via a diode 178 and an inductor 180 wired in a parallel configuration. The inductor 180 is preferably included to prevent damage to the circuit due to a sudden current surge if the circuit accidentally shorts to a high voltage source. The PWM output signal received by the field winding 96 of the second alternator 26 varies the output voltage of the second alternator 26. The output voltage of the second alternator 26 controls the glow plugs to the preselected resistance. As the voltage across the glow plugs increases so does the power dissipated in the glow plugs, likewise, the power dissipated in the glow plugs decreases when the voltage across the glow plugs decreases. The temperature of the glow plugs change relative to the amount of power they attempt to dissipate. Finally, the resistive element in the glow plugs change resistance value due to the change in temperature.

Advantageously, protection means 150 are included to prevent the modified voltage signal from exceeding a predetermined level. Should the modified voltage signal ever reach the predetermined level, the protection means 150 sends a signal to the voltage comparator 152 which causes the output from the triangle waveform generator 154 to momentarily reset to a preselected voltage. Additionally, a means 140 produces a constant positive voltage signal for delivery to the glow plugs. The constant voltage means 140 is used when the sensed current drops below a predetermined value, ie., the glow plug open circuits, or when a switch 142 is thrown. This protection allows the apparatus 20 to control the glow plugs even if the sensed glow plug 28 fails.

While the invention has been described in conjunction with specific embodiments, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

INDUSTRIAL APPLICABILITY

Assume that a six cylinder alcohol fueled diesel engine is equipped with the glow plug alternator control of this invention. As mentioned earlier in this specification, glow plug resistance varies linearly with glow plug temperature. Also, overheating constitutes a primary cause of glow plug failure. Before the engine can be started, the glow plugs must heat to a temperature sufficiently high to initiate combustion of the fuel. This temperature corresponds to the preselected resistance value. This is a value calculated to give optimum glow plug life, while providing satisfactory fuel combustion. After the glow plugs reach this preselected temperature, the engine is started.

Soon the friction of the pistons in the cylinders, in combination with many other factors, raises the temperature inside the cylinders. In a constant voltage type control, the cylinder heat increases the glow plug temperature. As the temperature increases the resistance increases, so the glow plug dissipates more power. However, in the glow plug alternator control, the resistance of the glow plugs is controlled. This has the effect of controlling the temperature of the glow plugs. Each glow plug resistance is controlled to the preselected resistance and are maintained substantially at the magnitude of the preselected resistance.

At start-up the engine is cold, so the measured glow plug resistance is less than the preselected glow plug resistance. Therefore, the comparing means outputs a 'high' logic voltage signal. This signal is sent to the output means, which adds power to the signal. The second alternator receives the high powered logic signal. The signal effects the field winding by increasing the current flowing through it, and the field winding current then increases the alternators output voltage. The glow plugs are connected in parallel with each other and with the alternator output. The glow plugs receive the alternator output voltage, which increases their resistance and temperature.

Soon the measured resistance exceeds the preselected resistance. This causes the comparator to output a 'low' logic voltage signal. The output means receives this signal and sends a low power logic signal to the alternator. This signal decreases the current in the field winding as well as the output voltage of the alternator. The 'low' output voltage decreases glow plug resistance and glow plug temperature.

The above described cycle controls the glow plug resistance and temperature within a small range about the preselected value.

Other aspects, objects, and advantages of this invention can be obtained from a study of the drawings, the disclosure, and the appended claims.

We claim:

1. An apparatus (20) for controlling the resistance of a glow plug (28) over various operating temperature ranges of an internal combustion engine (24), said apparatus comprising:

means (116) for sensing current through said glow plug (28) and delivering a signal relative to the magnitude of said sensed current;

means (118) for sensing voltage across said glow plug (28) and delivering a signal relative to the magnitude of said sensed voltage;

means (120,122) for modifying said sensed current and voltage signals to include a preselected resistance;

means (124) for comparing said modified current signal to said modified voltage signal to produce a resistance error signal in response to a difference between said compared signals;

means (126) for delivering a voltage signal to said glow plug (28) to control said glow plug's resistance relative to said preselected resistance in response to receiving the resistance error signal.

2. The apparatus (20), as set forth in claim 1, wherein said modifying means (120,122) includes:

means (132) for multiplying said sensed current signal by a first coefficient; and means (144) for multiplying said sensed voltage signal by a second coefficient.

3. The apparatus (20), as set forth in claim 2, wherein the quotient of the first coefficient divided by the second coefficient equals said preselected resistance.

4. The apparatus (20), as set forth in claim 1, wherein said comparing means (124) includes:

means (151) for pulse width modulating said resistance error signal.

5. The apparatus (20), as set forth in claim 4, wherein said comparing means (124) increases the duty cycle of said pulse width modulated resistance error signal in response to said modified current signal being greater than said modified voltage signal, and decreases the duty cycle of said pulse width modulated resistance error signal in response to said modified current signal being less than said modified voltage signal.

6. The apparatus (20), as set forth in claim 1, wherein:

a first alternator (22) electrically powers said apparatus (20); and a second alternator (26) electrically powers only said glow plug (28).

7. The apparatus (20) as set forth in claim 1, wherein said engine has a plurality of glow plugs (28,30,32,34,36,38), said delivering means (126) controls the resistance of said plurality of glow plugs relative to said preselected resistance in response to receiving the resistance error signal derived from one of said plurality of glow plugs.

8. The apparatus (20), as set forth in claim 7, wherein:

a first alternator (22) electrically powers said apparatus; and a second alternator (26) electrically powers only said plurality of glow plugs (28,30,32,34,36,38).

* * * * *